US007527149B2

(12) United States Patent
Wu

(10) Patent No.: US 7,527,149 B2
(45) Date of Patent: May 5, 2009

(54) EXHIBITION DEVICE FOR REVERSAL SPANNERS

(75) Inventor: Arthur Wu, Taichung Hsien (TW)

(73) Assignee: Proxene Tools Co., Ltd., Taichung (TW)

( * ) Notice: Subject to any disclaimer, the term of this patent is extended or adjusted under 35 U.S.C. 154(b) by 536 days.

(21) Appl. No.: 11/333,659

(22) Filed: Jan. 18, 2006

(65) Prior Publication Data

US 2007/0163915 A1 Jul. 19, 2007

(51) Int. Cl.
*A45C 11/26* (2006.01)

(52) U.S. Cl. ..... 206/349; 206/376

(58) Field of Classification Search ..... 206/349, 206/495, 372, 376–378, 382, 477, 478, 480, 206/481, 806; 211/70.6, 85.26; 248/309.1
See application file for complete search history.

(56) References Cited

U.S. PATENT DOCUMENTS 6,375,005 B1 * 4/2002 McCann ..... 206/349
6,837,373 B2 * 1/2005 Huang ..... 206/376
7,428,969 B2 * 9/2008 Wu ..... 206/349
2002/0027092 A1 * 3/2002 Hu ..... 206/378
2006/0091038 A1 * 5/2006 Hu ..... 206/495
2007/0007156 A1 * 1/2007 Wu ..... 206/376

* cited by examiner

*Primary Examiner*—Mickey Yu
*Assistant Examiner*—Steven A Reynolds
(74) *Attorney, Agent, or Firm*—Banger Shia

(57) ABSTRACT

An exhibition device for reversal spanners includes a suspending plate having a buckling hole; a periphery of the buckling hole being formed with a notch so as to form as a confining unit; an inner side of the confining unit having a plurality of limiting teeth; and a seat; a connecting unit extending from the seat; the connecting unit being rotatably buckled to the buckling hole; a ratchet portion being formed on a surface of the connecting unit; the ratchet portion being not aligned to the notch; and the ratchet portion being engageable to the limiting teeth.

6 Claims, 6 Drawing Sheets

EXHIBITION DEVICE FOR REVERSAL SPANNERS

FIELD OF THE INVENTION

The present invention relates to exhibition devices, and in particular to an exhibition device for reversal spanners, wherein it can prevent the seat from rotating reversally and the reversal spanner will restore by idle rotation. Thereby the spanner can rotate bi-directionally. Thus the spanner suspending on the suspending plate can be tested easily by the buyers. Furthermore, the present invention can emit sound as the teeth thereof slides. The user can determine the smoothness of the driving operation.

BACKGROUND OF THE INVENTION

Some prior arts, such as U.S. Pat. No. 6,375,005, U.S. Pat. No. 6,409,015 and U.S. Pat. No. 6,464,840 disclose structures about exhibition frames.

In these prior arts, when a ratchet spanner restores, a hexagonal seat will rotate with the ratchet spanner due to the defect in the design of the seat and the suspending plate. Thereby the ratchet spanner loses the mechanism of idle rotation in restoring. However this is not beneficial in test. Thus in test, the user can only test the spanner in a predetermined direction. The user cannot know the smoothness of the spanner as the spanner idly rotates. Thereby the prior art is not an idle design.

SUMMARY OF THE INVENTION

Accordingly, the primary object of the present invention is to provide an exhibition device for reversal spanners, wherein it can prevent the seat from rotating reversally and the reversal spanner will restore by idle rotation. Thereby the spanner can rotate bi-directionally. Thus the spanner suspending on the suspending plate can be tested easily by the buyers. Furthermore, the present invention can emit sound as the teeth thereof slides. The user can determine the smoothness of the driving operation.

To achieve above objects, the present invention provides an exhibition device for reversal spanners which comprises a suspending plate having a buckling hole; a periphery of the buckling hole being formed with a notch so as to form as a confining unit; an inner side of the confining unit having a plurality of limiting teeth; and a seat; a connecting unit extending from the seat; the connecting unit being rotatably buckled to the buckling hole; a ratchet portion being formed on a surface of the connecting unit; the ratchet portion being not aligned to the notch; and the ratchet portion being engageable to the limiting teeth.

Furthermore, the present invention provides an exhibition device for reversal spanners which comprises a suspending plate having a buckling hole; a periphery of the buckling hole; a front side has a ratchet portion at a periphery of the buckling hole; and a seat; a connecting unit extending from the seat; the connecting unit being rotatably buckled to the buckling hole; the seat having a diak; a bottom of the disk having notch as a limiting unit; a bottom of the disk being formed with teeth which is engageable to the ratchet portion.

The various objects and advantages of the present invention will be more readily understood from the following detailed description when read in conjunction with the appended drawing.

DETAILED DESCRIPTION OF THE INVENTION

Figure 1:
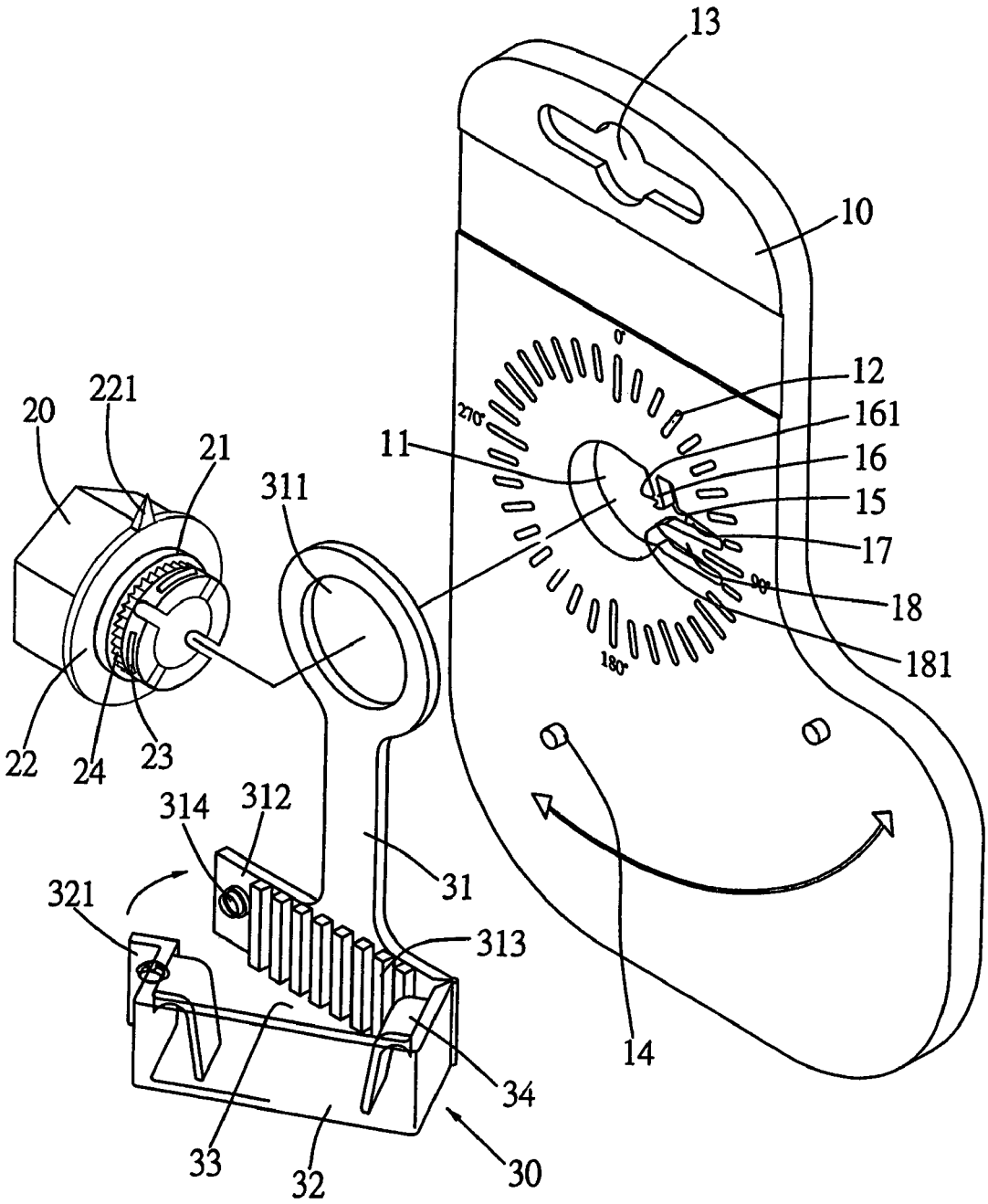
FIG. 1 is an exploded schematic view about the exhibition device for reversal spanners of the present invention.
Figure 2:
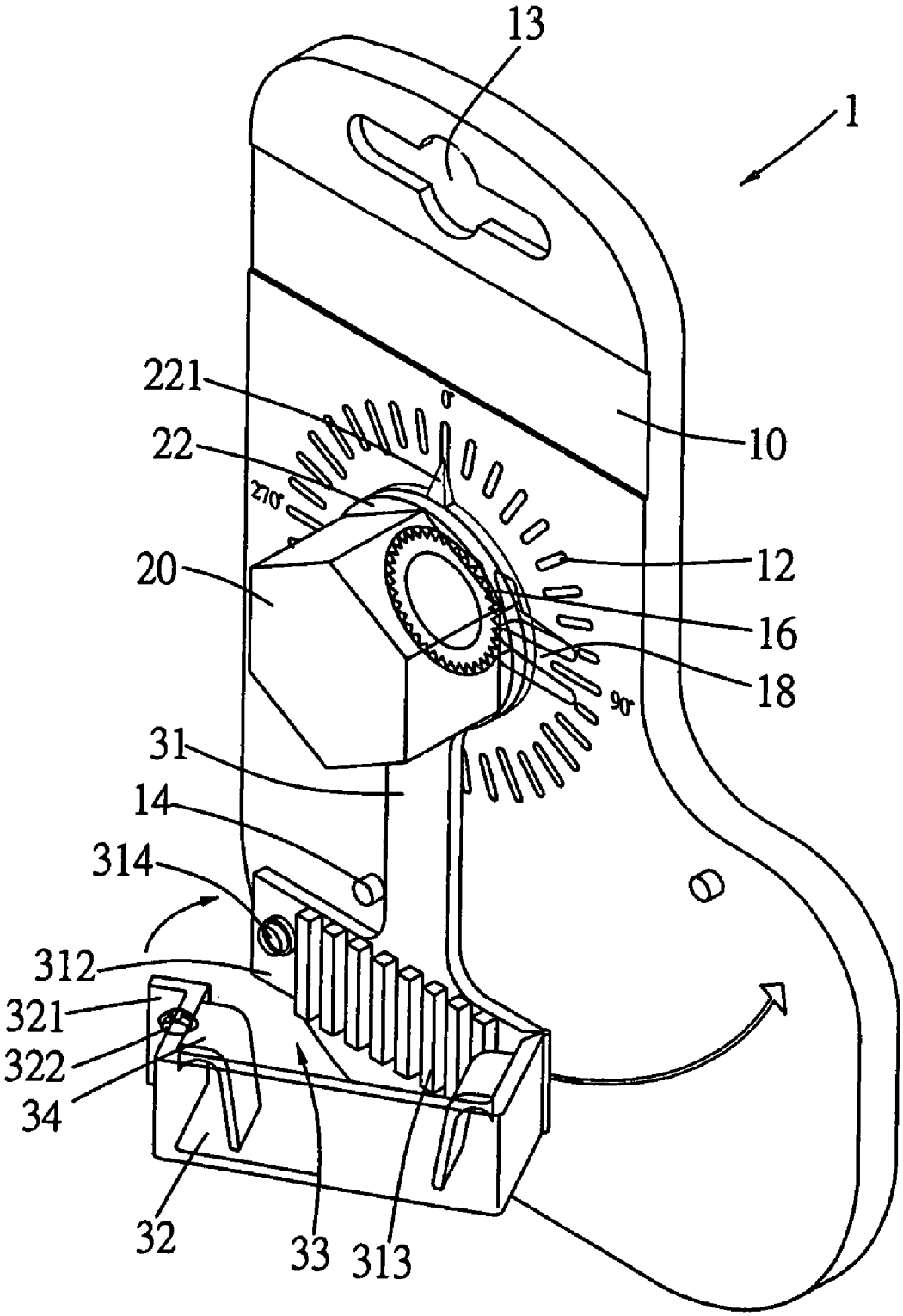
FIG. 2 is a perspective view about the exhibition device for reversal spanners of the present invention.
Figure 3:
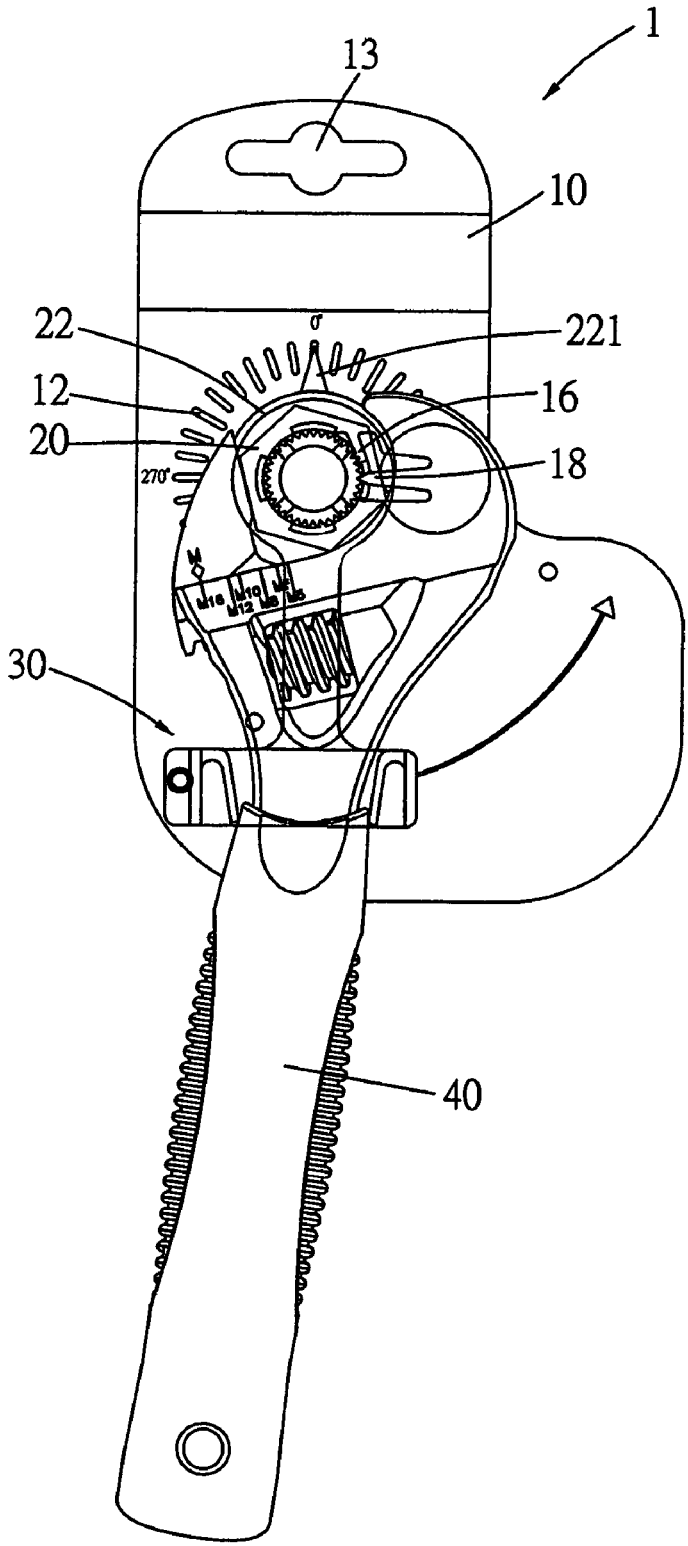
FIG. 3 shows the use of the present invention, wherein the exhibition device for reversal spanners of the present invention is combined with a reversal spanner.
Figure 4:
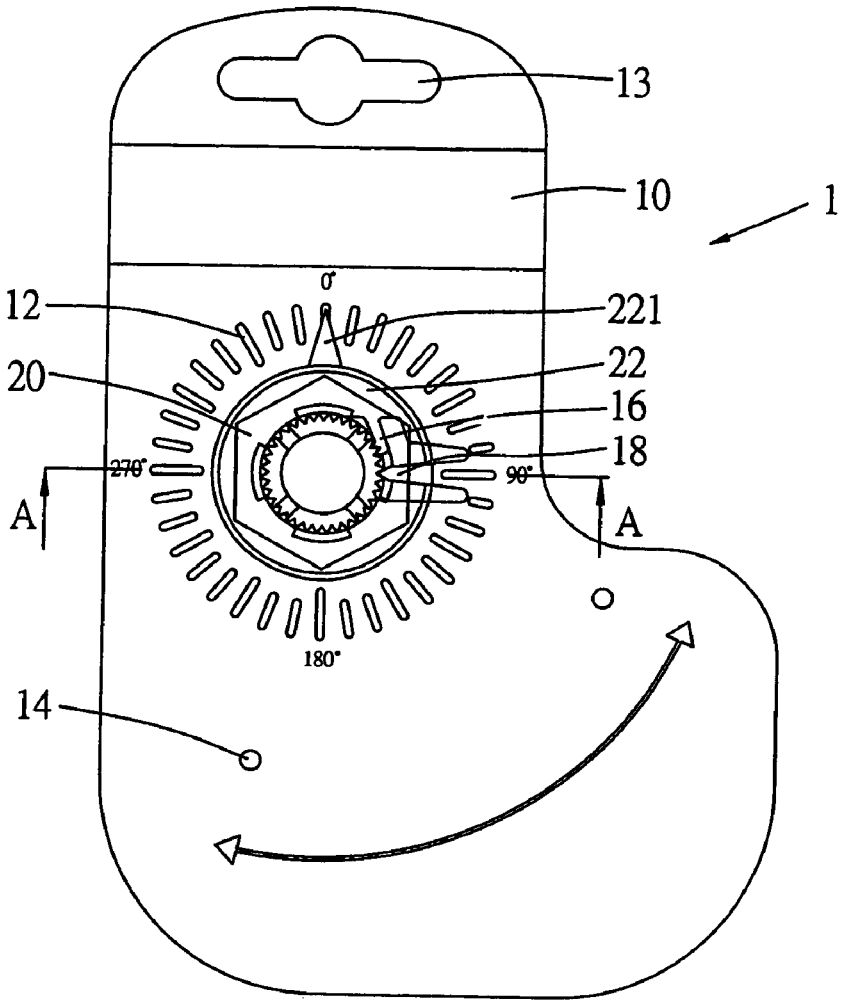
FIG. 4 is a plane view about the, exhibition device for reversal spanners of the present invention.
Figure 5:
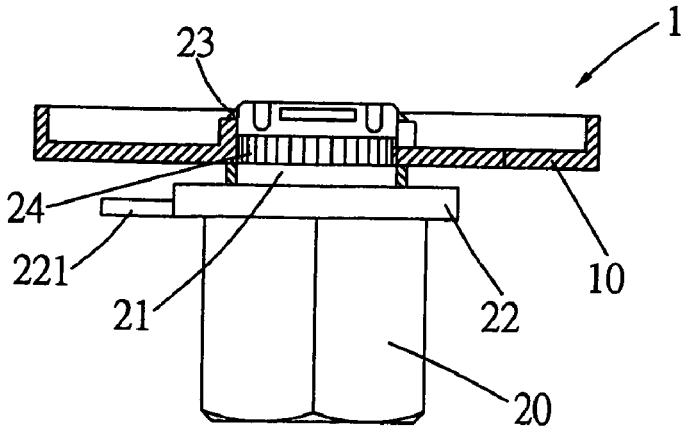
FIG. 5 is a schematic view along line A-A of FIG. 4.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 5, the exhibition frame 1 of the present invention has the following elements.

A suspending plate 10 has a buckling hole 11. A scale portion 12 is formed around the buckling hole 11. A suspending hole 13 is formed above the buckling hole 11. At least one post 14 is installed below the buckling hole 11. One side of the buckling hole 11 is formed with a notch 15. A periphery of the notch 15 is formed with a long confining unit 16. An inner side of the confining unit 16 is formed with a plurality of teeth 161 with 45 degrees sides. Two symmetrical slits 17 are formed aside the confining unit 16. An elastic sheet 18 is formed between the two slits 17. A front end (inner side) of the elastic sheet 18 is formed as an inclined tip portion 181.

A seat 20 has a hexagonal shape. A lower end of the seat 20 is extended with a bar-like connecting unit 21. At the connection of the seat 20 and the connecting unit 21 is formed with an enlarged disk 22. A triangular indication 221 extends from the disk 22. A lower surface of the connecting unit 21 is formed with a cruciform slot. Thus, when the connecting unit 21 is compressed, it will reduce inwards. Thus, the connecting unit 21 can be inserted into the buckling hole 11 and then it is buckled to the suspending plate 10 by a buckle 23 of the seat 20 to resist against a rear surface of the suspending plate 10.

A limiting frame 30 has a T shape connecting plate 31 and a U shape frame plate 32. A top end of the connecting plate 31 has a toggle 311 and a lower end thereof is transversally extended with a plate like sealing plate 312. A surface of the sealing plate 312 is formed with a plurality of strips 313. One side of the sealing plate 312 is formed with a buckling hole 314 and another side thereof is integrally extended with a frame plate 32. One lateral side of the frame plate 32 has a wing 321 which can be adhered to the sealing plate 312. A surface of the wing 32 is installed with a buckle body 322 capable of being combined to the buckling hole 314 so that the connecting plate 31 and the frame plate 32 are formed with a receiving portion 33 which can be opened. Thereby a reversal spanner 50 can be received in the two short sides of the receiving portion 33 so as to form as a clamping sheet 34 for clamping the reversal spanner 40. Above mentioned structure is the structure of the present invention.

Assembly of the present invention will be described herein. The toggle 311 at the top of the T shape connecting plate 31 is suspended to the connecting unit 21 of the seat 20. Then the connecting unit 21 is pressed into the buckling hole 11. The buckle 23 at the front end thereof resists against the suspending plate 10. Then a reversal spanner (in this embodiment, it is a reversal adjustable spanner, however it can be an open mouth spanner or a ratchet wheel spanner) passes through the receiving portion 33 formed by the connecting plate 31 and the frame plate 32. The strips 33 on the surface of the sealing portion 312 will press and the spanner and the elastic sheet2 34 at two sides will elastically clamp the spanner. Thereby the driving portion of the spanner 40 will be engaged to the hexagonal seat 3. The ratchet wheel 24 at the surface of the connecting unit 21 of the seat 20 is engaged to the teeth 161 of the confining unit 16. Meanwhile, it is horizontally engaged to the tip portion 181 of the elastic sheet 18.

In use, the user holds the handle of the spanner 50 to rotate clockwise toward the post 14. The post 14 is limited not to move forwards. The spanner 50 will drive the seat 20 to rotate with the seat 20. The ratchet portion 24 of the seat 30 will be engaged to the teeth 161 of the confining unit 16 and the tip portion 181 at the front end of the elastic sheet 18. They will emit sound as the teeth slides. Thereby the user can adjust the smoothness of the driving operation.

The reason that the seat 20 can rotate along a predetermined direction is that the seat 20 will press the confining unit 16 to move toward the notch 15. The seat 20 will rotate by the driving operation of the spanner 40.

Figure 6:
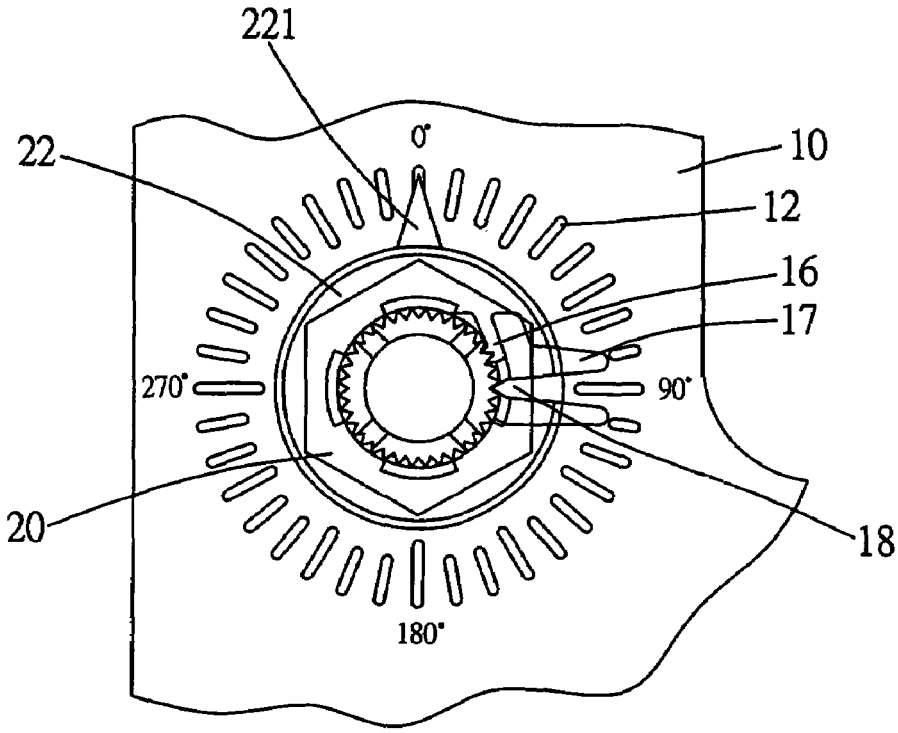
FIG. 6 is a schematic view about the operation of reversal rotation of the seat of the exhibition device for reversal spanners of the present invention.
Figure 6A:
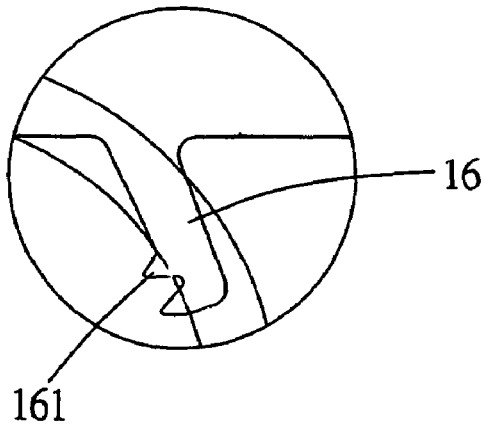
FIG. 6A is a partial enlarged view of FIG. 6.

On the contrary, referring to FIGS. 6 and 6A, when the reversal spanner 50 restores along a reversal direction, it will drive the seat 30 to rotate reversally. The seat 20 is limited by the resisting affect of the confining unit 16 and the ratchet portion 24 of the connecting unit 21, the ratchet 24 will be stopped by the confining unit 16. Thereby the spanner 40 will rotate idly for next use.

In the present invention, the suspending plate 10 is installed with a confining unit 16 corresponding to the ratchet portion 24 of the seat 20. It can prevent the seat 20 to rotate reversally and the reversal spanner 40 will restore by idle rotation. Thereby the spanner can rotate bi-directionally. Thus the spanner suspending on the suspending plate can be tested easily by the users.

Figure 7:
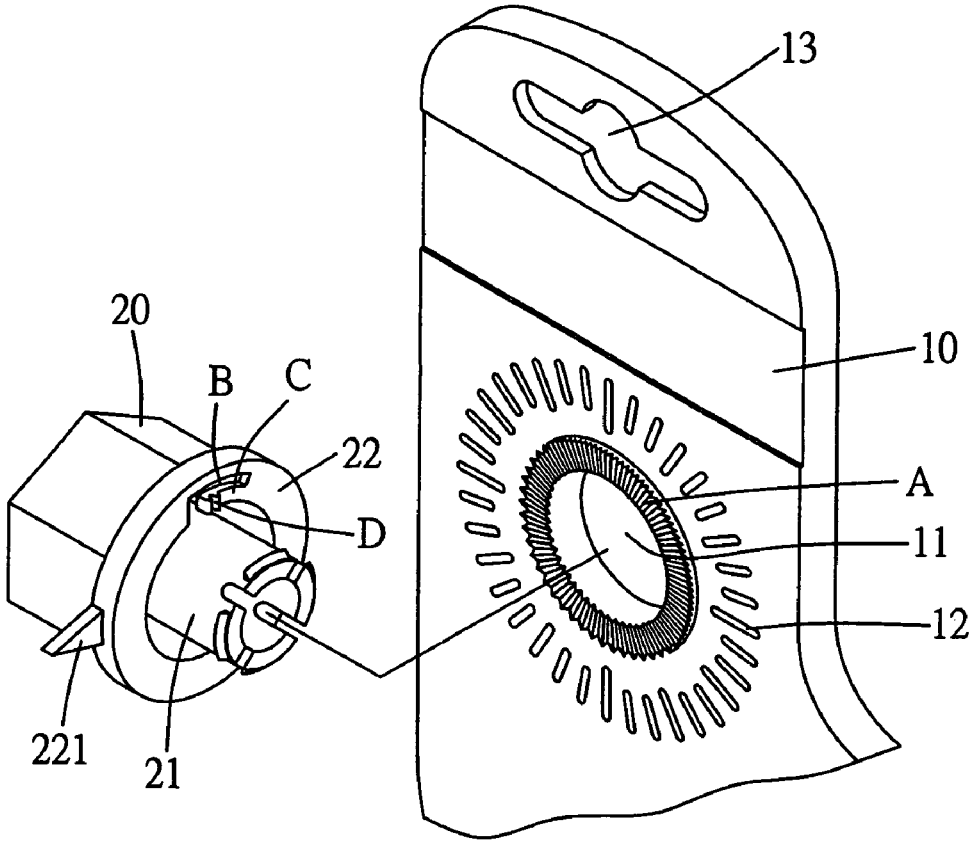
FIG. 7 is an exploded schematic view about the second embodiment of the exhibition device for reversal spanners of the present invention.
Figure 8:
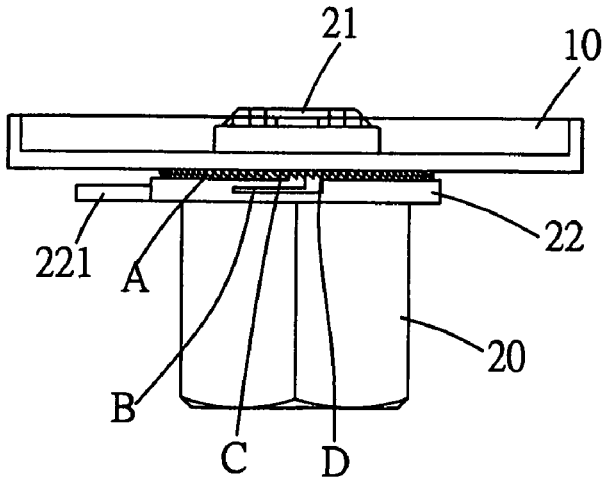
FIG. 8 is a structural perspective view of the second embodiment of the exhibition device for reversal spanners of the present invention.

Referring to FIGS. 7 and 8, the second embodiment of the present invention is illustrated. Those identical to the first embodiment will be identified by the same numerals. Thus the details will not be described herein.

In this embodiment, a bottom side of the disk 22 is formed with a notch B. A limiting unit C is formed aside the notch B. A bottom of the limiting unit C is formed with a plurality of teeth D. One side of each tooth D is an inclined surface and another side thereof is a vertical surface.

A ratchet portion A is installed at a front surface of the suspending plate 10 and at a periphery of the buckling hole 11. The ratchet portion A has a teeth which is engageable to the limiting teeth D. When the seat 20 is driven by a reversal spanner 40 to rotate along a predetermined direction, the inclined sides of the limiting teeth D will slide to make the limiting unit C to rotate toward the notch B. If the seat 20 is driven to rotate by the reversal spanner 40 to rotate reversally, it is limited by the engagement of the ratchet portion A at the front end surface of the suspending plate 10 and the limiting teeth D. Thereby the seat 20 is prevented from being driven reversally.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An exhibition device for reversal spanners comprising:

a suspending plate having a buckling hole; a periphery of the buckling hole being formed with a notch so as to form as a confining unit between the buckling hole and the notch; an inner side of the confining unit having a plurality of limiting teeth; and two symmetrical slits being formed aside the confining unit; an elastic sheet being formed between the two slits; a front end of the elastic sheet being formed as an inclined tip portion;

a seat, on the bottom of the seat being integrally extended a post-shaped connecting unit, at a connection of the seat and the connecting unit being formed an enlarged disk; the connecting unit being rotatably buckled to the buckling hole; a ratchet portion being formed on a surface of the connecting unit; the ratchet portion being aligned with the notch between the confining unit and the elastic sheet; and the ratchet portion being engageable to the limiting teeth of the confining unit and to the inclined tip portion of the elastic sheet.

2. The exhibition device for reversal spanners as claimed in claim 1, wherein a limiting frame is installed between the suspending plate and the seat for retaining a reversal spanner.

3. The exhibition device for reversal spanners as claimed in claim 1, wherein at least one post is installed below the buckling hole.

4. The exhibition device for reversal spanners as claimed in claim 2, wherein the limiting frame has a T shape connecting plate and a U shape frame plate; a top end of the connecting plate has a toggle and a lower end thereof is transversally extended with a plate like sealing plate so that the connecting plate and the frame plate are formed with a receiving portion which can be opened.

5. The exhibition device for reversal spanners as claimed in claim 4, wherein a surface of the sealing plate is formed with a plurality of strips; one side of the sealing plate is formed with a buckling hole and another side thereof is integrally extended with the frame plate; one lateral side of the frame plate has a wing which can be adhered to the sealing plate; a surface of the wing is installed with a buckle body capable of being combined to the buckling hole.

6. The exhibition device for reversal spanners as claimed in claim 4, wherein a side of the receiving portion has at least one elastic sheet.

* * * * *